US007864116B2

(12) United States Patent
Kurashima et al.

(10) Patent No.: US 7,864,116 B2
(45) Date of Patent: Jan. 4, 2011

(54) MOUNTING STRUCTURE OF ANTENNA DEVICE

(75) Inventors: Shigemi Kurashima, Shinagawa (JP); Masahiro Yanagi, Shinagawa (JP); Takashi Yuba, Shinagawa (JP); Satoshi Sakurai, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 88 days.

(21) Appl. No.: 12/081,685

(22) Filed: Apr. 18, 2008

(65) Prior Publication Data

US 2009/0115683 A1 May 7, 2009

(30) Foreign Application Priority Data

Nov. 5, 2007 (JP) ..... 2007-286944

(51) Int. Cl.
*H01Q 1/38* (2006.01)

(52) U.S. Cl. ..... 343/700 MS; 343/702

(58) Field of Classification Search ..... 343/878, 343/700 MS, 702, 749, 846, 858
See application file for complete search history.

(56) References Cited

U.S. PATENT DOCUMENTS

| | | | | |
|---|---|---|---|---|
| 6,642,892 | B2 * | 11/2003 | Masaki et al. | 343/702 |
| 2005/0024274 | A1 * | 2/2005 | Byun et al. | 343/702 |
| 2006/0097925 | A1 * | 5/2006 | Lee | 343/700 MS |
| 2008/0316115 | A1 * | 12/2008 | Hill et al. | 343/702 |
| 2009/0213012 | A1 * | 8/2009 | Jiang et al. | 343/700 MS |

FOREIGN PATENT DOCUMENTS

JP 2000-196327 7/2000

OTHER PUBLICATIONS

Takuya, Taniguchi et al., "An Omnidirectional and Low-VSWR Antenna for the FCC-Approved UWB Frequency Band", General Conference of the Institute of Electronics, Information, and Communication Engineers in 2003, 3 pages.

* cited by examiner

*Primary Examiner*—Jacob Y Choi
*Assistant Examiner*—Kyana R Robinson
(74) *Attorney, Agent, or Firm*—Staas & Halsey LLP

(57) ABSTRACT

A mounting structure of an antenna device for mounting the antenna device composed of a ground part and an element part on an electronic apparatus is disclosed. The ground part is mounted on the electronic apparatus so as to be substantially overlapped with a conductive part of the electronic apparatus.

6 Claims, 9 Drawing Sheets

MOUNTING STRUCTURE OF ANTENNA DEVICE

BACKGROUND OF THE INVENTION

1. Field of the Invention

The present invention relates generally to mounting structures of antenna devices and, in particular, to a mounting structure for mounting the antenna device composed of a ground member and an element member on an electronic apparatus.

2. Description of the Related Art

Recently and continuing, it is desired that computers and peripheral devices be wirelessly connected to each other as they become more advanced.

Under this circumstance, much attention is given to wireless communications technologies using ultra-wideband (UWB) that allows communications with large transmission capacity when the computers and the peripheral devices are connected to (in communication with) each other. The application of UWB within a frequency band from 3.1 to 10.6 GHz has been approved by the Federal Communications Commission (FCC) of the United States since 2002.

UWB refers to a communications method for communicating pulse signals over an ultra-wideband frequency range. Therefore, antennas for use in UWB require a structure capable of sending and receiving over the ultra-wideband frequency range.

As an antenna to be used within a frequency band from 3.1 to 10.6 GHz approved by at least the FCC, an antenna device is proposed that is configured to have a flat-plate-shaped bottom board and a conical or teardrop-shaped power supply body mounted thereon (see Non-Patent Document 1).

Because the typical ultra-wideband antenna device is configured to have the flat-plate-shaped bottom board and the conical or teardrop-shaped power supply body mounted thereon, it is large in size. Therefore, it is desired that the antenna device be downsized and made thinner.

On the other hand, as a loop antenna for use in communications at low frequency bands, an antenna device is proposed in which an element member is formed with a conductive pattern on a flexible substrate (see Patent Document 1).

Patent Document 1: JP-A-2000-196327

Non-Patent Document 1: "An Omnidirectional and Low-VSWR Antenna for the FCC-Approved UWB Frequency Band (B-1-1333)" of Proceedings of the IEICE General Conference in 2003, written by Takuya Taniguchi and Takehiko Kobayashi of Tokyo Denki University (presented at room 201 on March 22)

SUMMARY OF THE INVENTION

As electronic apparatuses become smaller in size, it is desired that antenna devices incorporated in the electronic apparatuses be downsized and space for mounting the antenna devices be reduced.

The present invention has been made in view of the above points and may provide a mounting structure capable of mounting the antenna device while providing space savings.

According to an aspect of the present invention, a mounting structure for mounting the antenna device composed of a ground part and an element part on an electronic apparatus is provided. The ground part is mounted on the electronic apparatus so as to be substantially overlapped with the conductive part of the electronic apparatus.

The element part may include a first element forming part that is arranged substantially parallel to the ground part; and a second element forming part that projects from a side of the ground part and has a tip end connected to the first element forming part.

The ground part may be electromagnetically coupled with the conductive part of the electronic apparatus.

The antenna device may include a substrate; and a conductive pattern that is formed on the substrate and forms patterns of the element part and the ground part.

The antenna device may be covered with an insulation material.

The element part may be formed into either a T-shape or an L-shape.

The antenna device may constitute an ultra-wideband antenna.

The conductive part of the electronic apparatus may refer to a bezel of a display unit.

According to embodiments of the present invention, the antenna device composed of the ground part and the element part is mounted on the electronic apparatus such that the ground part is substantially overlapped with the conductive part of the electronic apparatus. Accordingly, the ground part of the antenna device can be replaced by the conductive part of the electronic apparatus, whereby the ground part can be made small and used as the mounting part in the electronic apparatus. As a result, it is possible not only to downsize the antenna device but also reduce the projection of the antenna device from the conductive part. Note that because the element part outwardly projects from the conductive part, the performance of the antenna device is not degraded.

DETAILED DESCRIPTION OF THE PREFERRED EMBODIMENT

Figure 1:
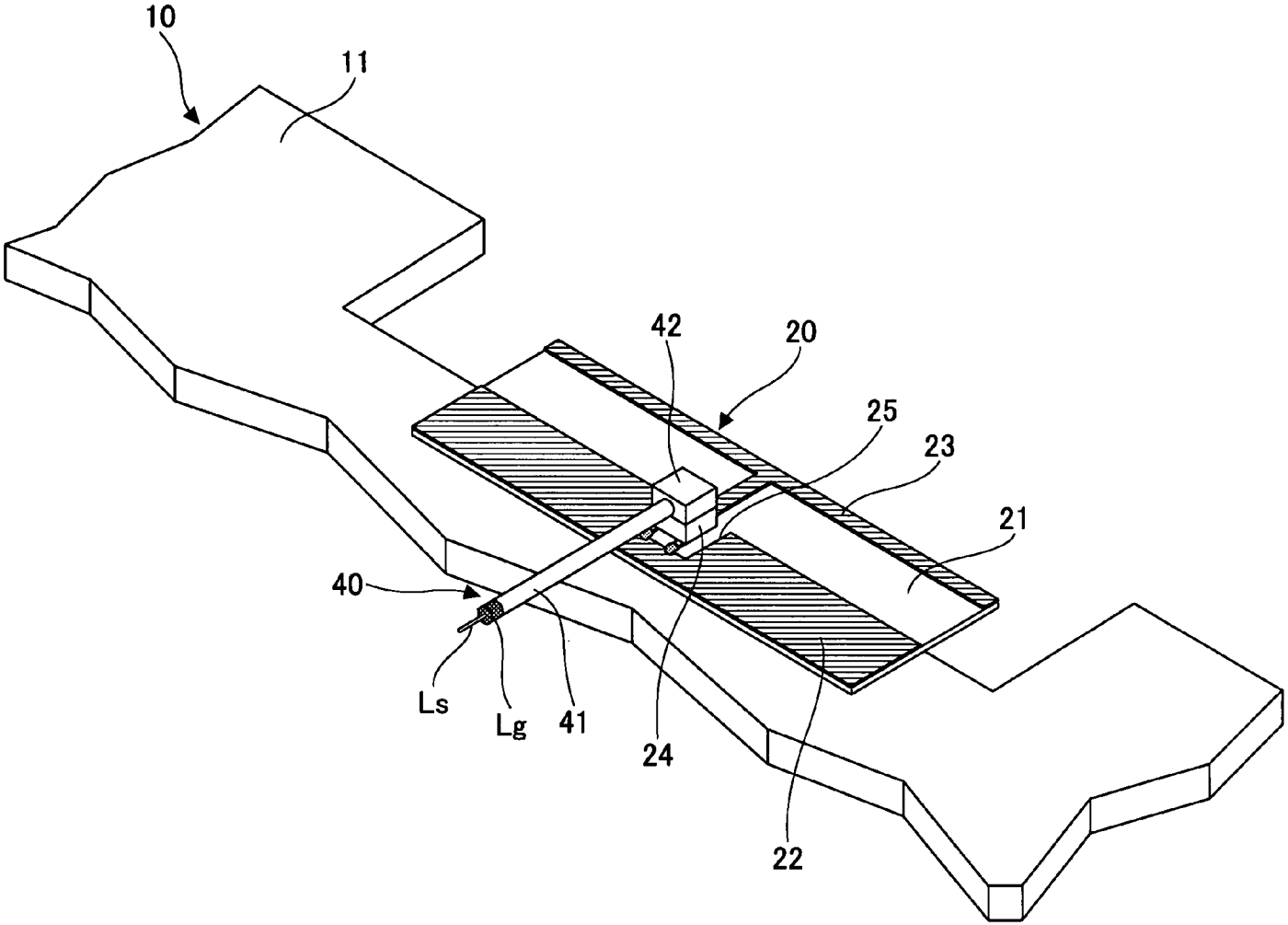
FIG. 1 is a perspective view showing a substantial part of an embodiment of the present invention.
Figure 2:
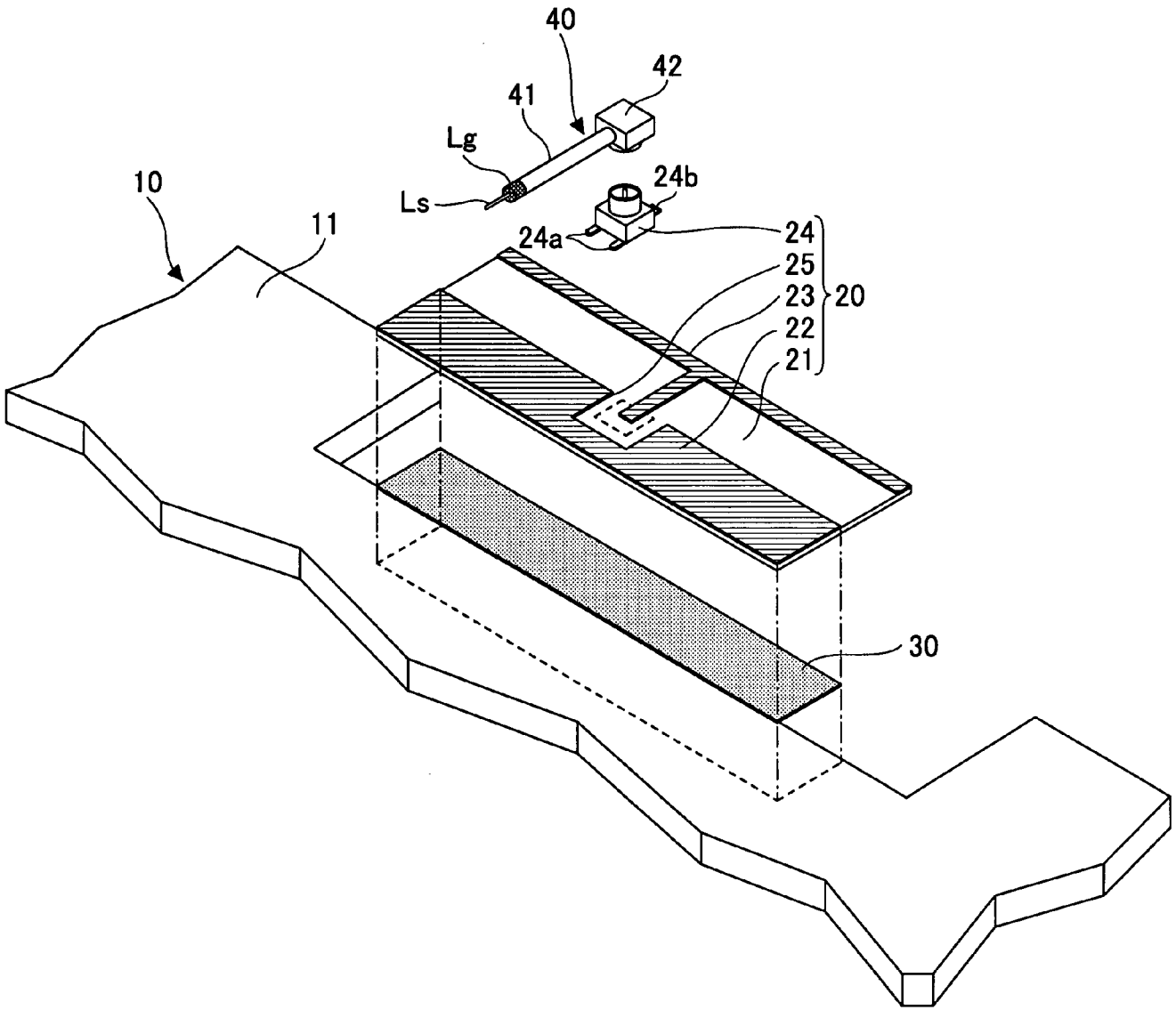
FIG. 2 is an exploded perspective view showing the substantial part of the embodiment of the present invention.
Figure 3A:
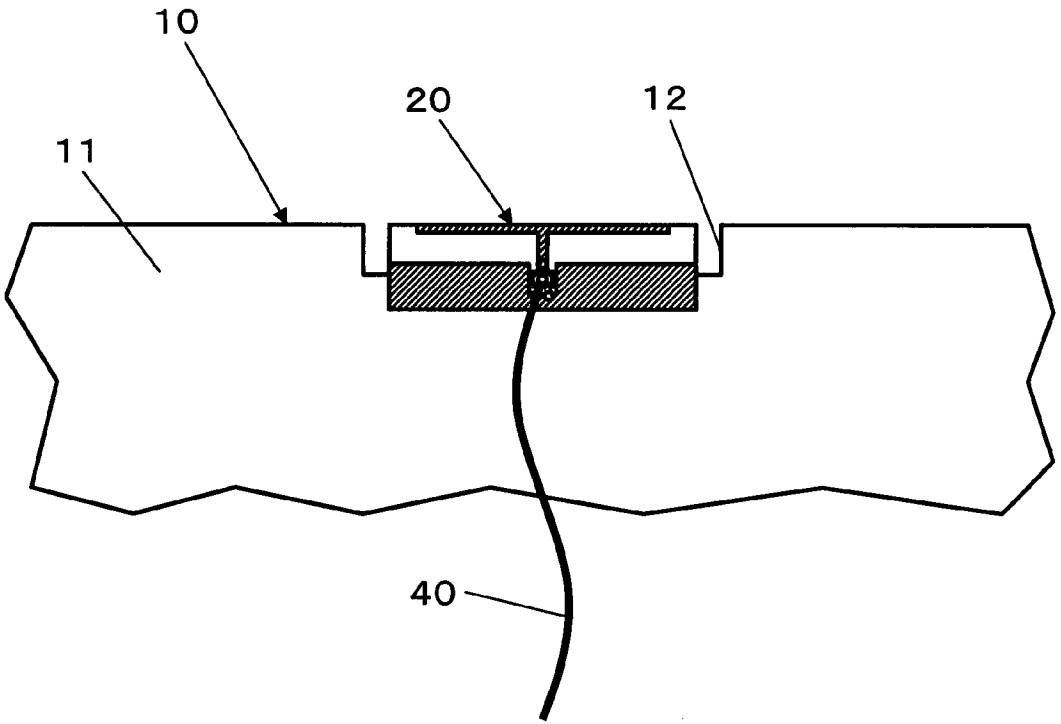
FIGS. 3A and 3B are views showing the substantial part of the embodiment of the present invention.
Figure 3B:
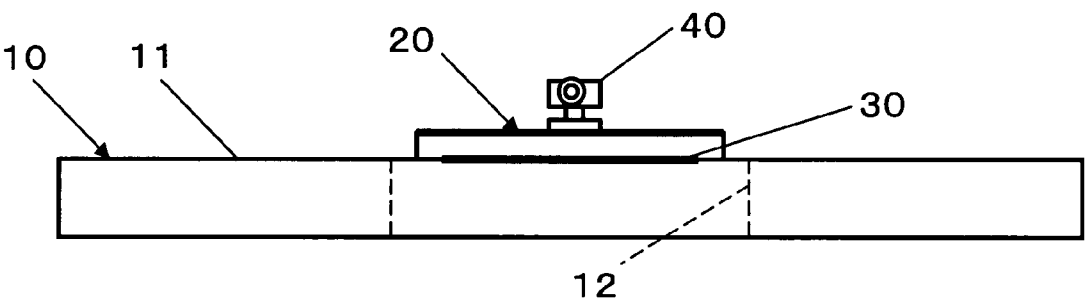
Figure 4A:
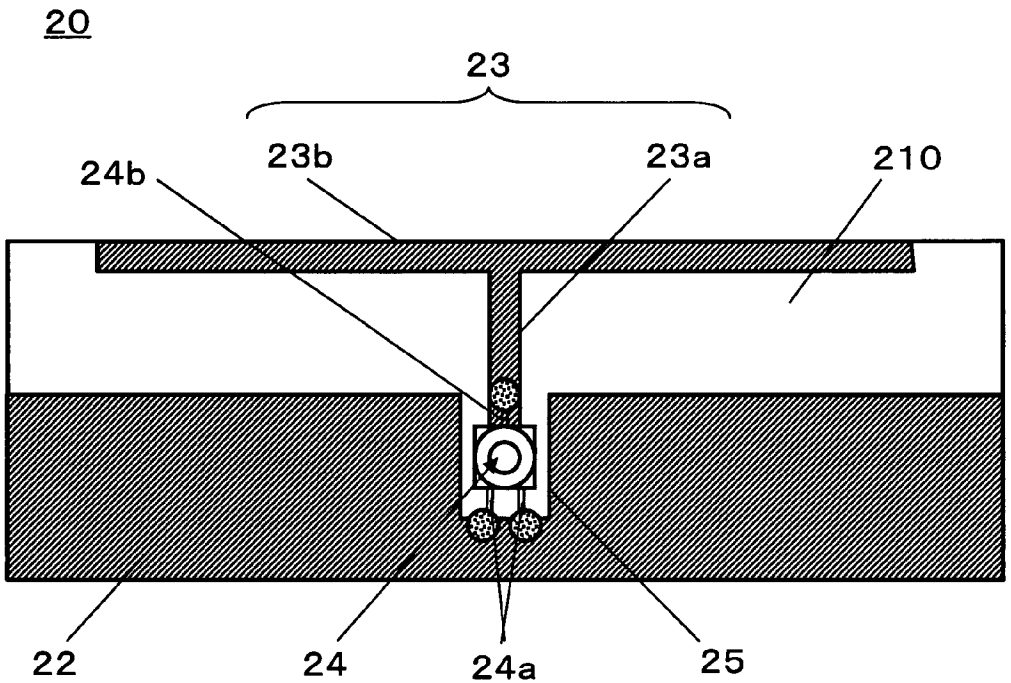
FIGS. 4A and 4B are views showing an antenna device.
Figure 4B:
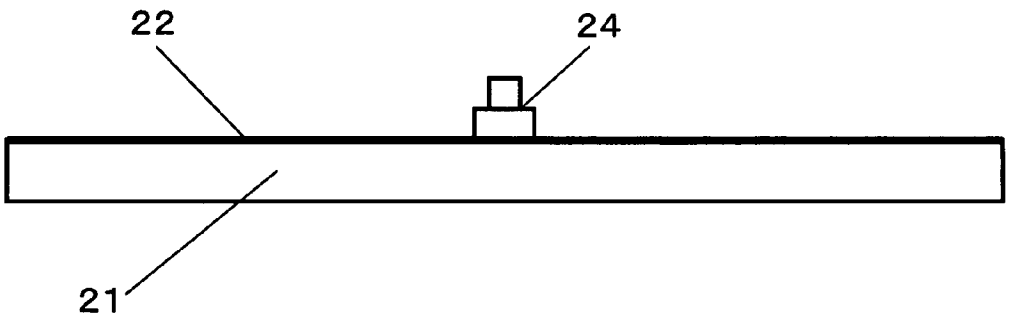

FIG. 1 is a perspective view showing a substantial part of an embodiment of the present invention. FIG. 2 is an exploded perspective view showing the substantial part of the embodiment of the present invention. FIGS. 3A and 3B are views showing the substantial part of the embodiment of the present invention. FIGS. 4A and 4B are views showing an antenna device 20.

As the mounting structure of the antenna device 20 according to this embodiment, the antenna device 20 is fixed to an antenna mounting part 12 formed at a conductive part 11 of an electronic apparatus 10 by a double-faced tape 30 made, for example, of a dielectric material.

The conductive part 11 of the electronic apparatus 10 refers, for example, to a housing, a circuit board, a frame, a shielding plate, or a shielding part.

The antenna device 20 is configured such that a ground pattern 22 and an element pattern 23 made of a conductive material are formed on a substrate 21 and a connector 24 is soldered to the ground pattern 22 and the element pattern 23.

The substrate 21 is made, for example, of a resinous plate material such as polyimide having a width of approximately 30 mm, a depth of approximately 10 mm, and a thickness of approximately 0.1 mm. Note that the substrate 21 may be made of a resin (dielectric) film material such as PET having flexibility.

The ground pattern 22 is a ground part of the antenna device 20 and made of a conductive material film. The ground pattern 22 is formed over approximately the entire width in the longitudinal direction and approximately half the width in the depth direction of the substrate 21.

The element pattern 23 is an element part of the antenna device 20 and made of a conductive material film having a width of approximately 1 mm or smaller. The element pattern 23 has a first element forming part 23*a* that projects substantially orthogonal to a side of the ground pattern 22 on the substrate 21 and a second element forming part 23*b* that is connected to a tip end of the first element forming part 23*a* and arranged substantially parallel to the side of the ground pattern 22. Note that the conductive material forming the ground pattern 22 and the element pattern 23 is, for example, a metal material such as copper or aluminum.

The first and second element forming parts 23*a* and 23*b* are combined to form the T-shaped element pattern 23. The element pattern 23 electromagnetically acts on the ground pattern 22 to perform the transmission and reception of electric waves.

Note that the second element forming part 23*b* has a length of approximately 24 mm so as to be substantially parallel to the side of the ground pattern 22 at a position spaced apart by approximately 4 through 5 mm from the side of the ground pattern 22.

The coaxial socket connector 24 is fixed within a connector attachment part 25 formed, for example, at the side of the ground pattern 22. The connector attachment part 25 is formed into a concave shape by cutting out a part of the ground pattern 22. A ground terminal 24*a* of the coaxial socket connector 24 is soldered to the ground pattern 22 and a signal terminal 24*b* is soldered to an end of the first element forming part 23*a*.

The coaxial socket connector 24 is connected to a coaxial plug connector 42 connected to one end of a cable 41 of a coaxial cable 40, and the coaxial socket connector 24 is thus connected to the cable 41. The coaxial plug connector 42 is attached to the coaxial socket connector 24, whereby the element pattern 23 and the ground pattern 22 are connected to a signal line Ls of the cable 41 and a grounding line Lg thereof, respectively.

The antenna device 20 is mounted on the electronic apparatus 10 by the double-faced tape 30 such that the ground pattern 22 is overlapped with the conductive part 11 of the electronic apparatus 10. In the antenna device 20, the ground pattern 22 is covered with a resin material (dielectric material) having an insulation property, and the ground pattern 22 is electromagnetically coupled with the conductive part 11.

Figure 5:
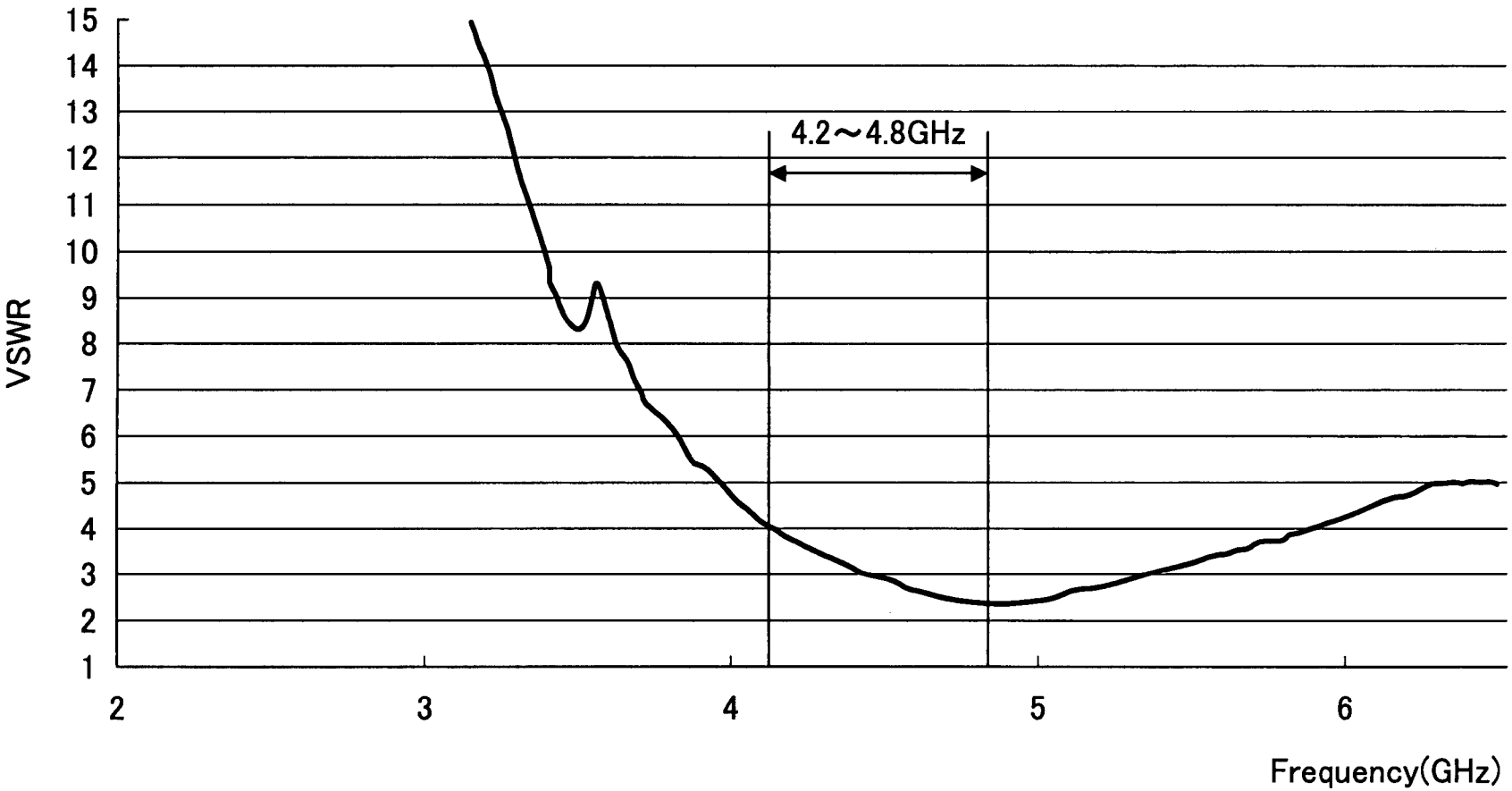
FIG. 5 is graphical representation showing a VSWR characteristic in the mounting structure of the antenna device according to an embodiment of the present invention.

FIG. 5 is graphical representation showing a VSWR characteristic in the mounting structure of the antenna device 20 according to an embodiment of the present invention.

As shown in FIG. 5, in the mounting structure of the antenna device 30 according to this embodiment, VSWR falls below approximately 4 at a frequency band from approximately 4.2 to 4.8 GHz, thereby making it possible to provide sufficient antenna performance for practical use.

According to this embodiment of the present invention, the antenna device 20, in which the ground pattern and the element pattern 23 are formed on the substrate 21, can be mounted on the antenna mounting part 12 formed at the conductive part of the electronic apparatus 10 such that the ground pattern 22 is substantially overlapped with the conductive part 11. Accordingly, the antenna device 20 can be incorporated in the electronic apparatus 20 without making the antenna device 20 project from the conductive part 11 of the electronic apparatus 10, i.e., the housing, the circuit board, the frame, the shielding plate, the shielding part, etc., of the electronic apparatus 10.

Furthermore, because the ground part of the antenna device 20 can be replaced by the conductive part 11 of the electronic apparatus 10, it is possible to make the ground pattern 22 small. That is, the mounting part in the electronic apparatus 10 can be used as a part for forming the ground pattern 22, thereby making it possible to downsize the antenna device 20. Moreover, the element pattern 23 outwardly projects from the conductive part 11. Therefore, it is possible not only to reduce the projection of the antenna device 20 but also to prevent the degradation of the performance of the antenna device 20.

Accordingly, it is possible to mount the antenna device 20 on the electronic apparatus 10 while providing space savings without causing the degradation of the performance of the antenna device 20.

Note that in this embodiment the antenna mounting part 12 of the electronic apparatus 10 is formed such that a side of the conductive part 11 is cut into a concave shape, but it may not be formed into the concave shape.

Figure 6C:
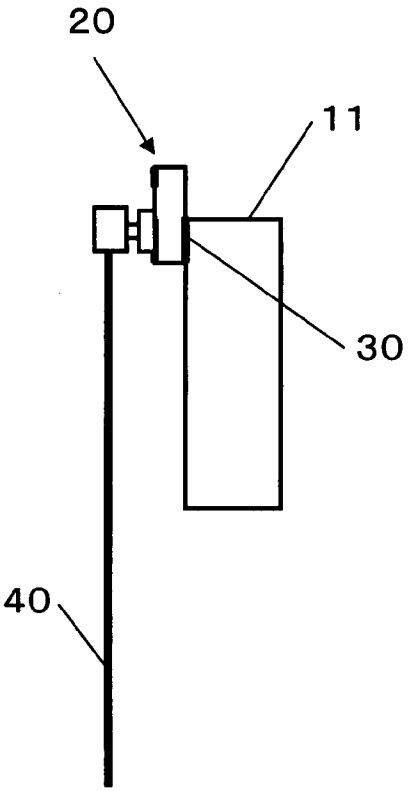
FIGS. 6A through 6C are views showing the substantial part according to another embodiment of the present invention.
Figure 6A:
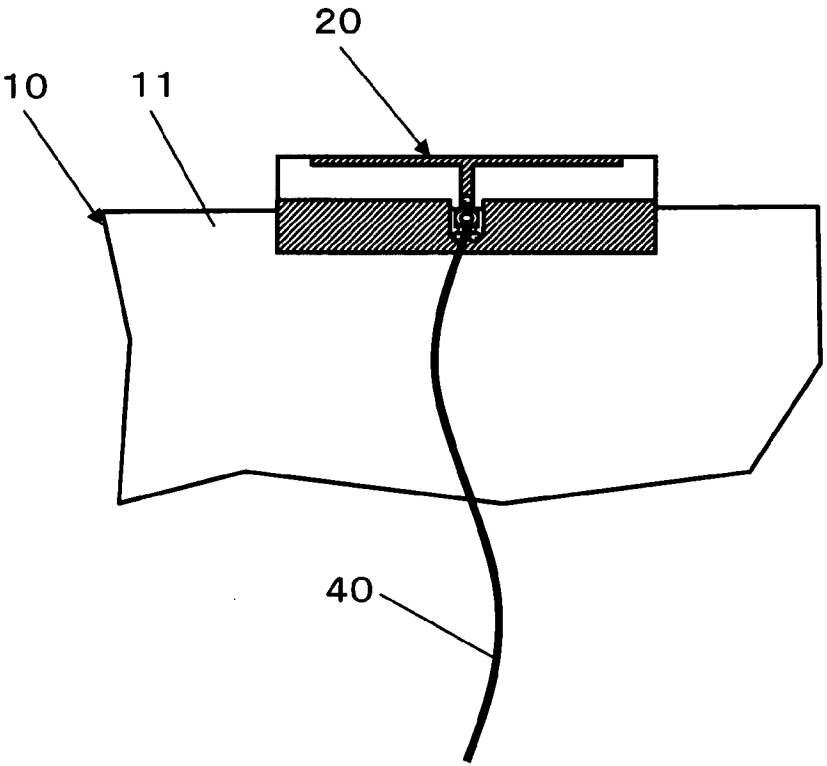
Figure 6B:
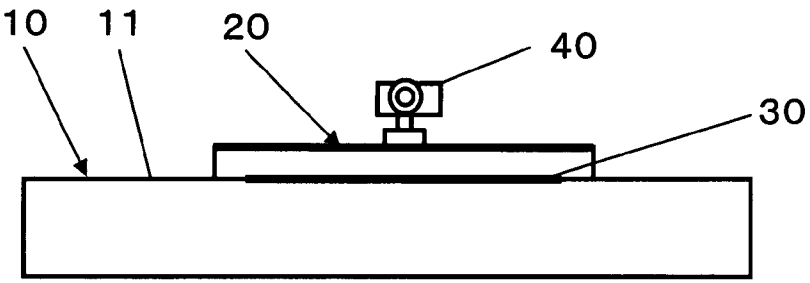

FIGS. 6A through 6C are views showing the substantial part according to another embodiment of the present invention.

According to this embodiment, the ground pattern 22 of the antenna device 20 is fixed to the side of the conductive part 11 of the electronic apparatus 10 by the double-faced tape 30. Accordingly, only the element pattern 23 outwardly projects from the side of the conductive part 11 of the electronic apparatus 10. As a result, it is possible not only to reduce the projection of the antenna device 20 from the conductive part 11 but also to prevent the degradation of the performance of the antenna device 20.

Figure 7:
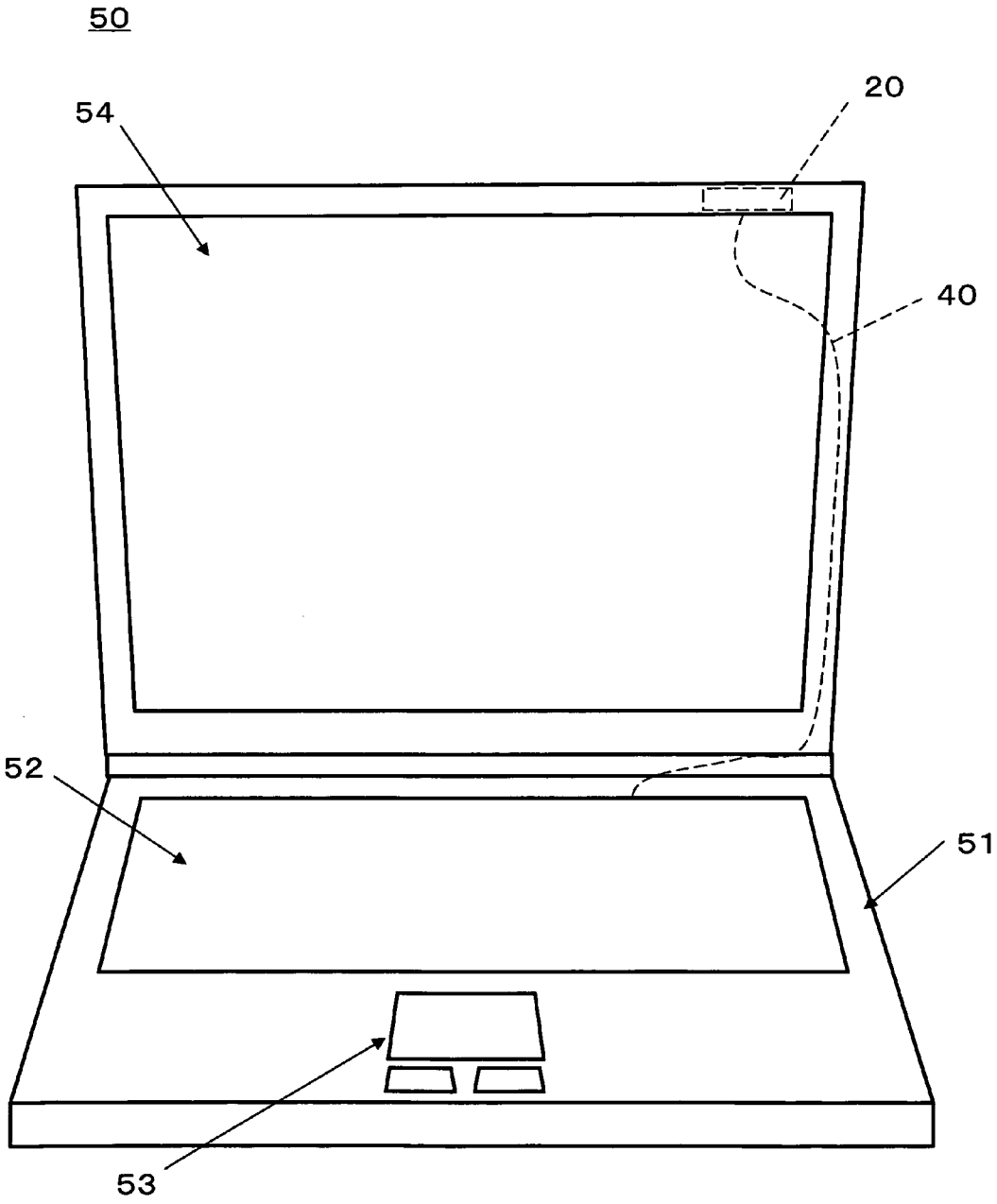
FIG. 7 is a perspective view showing an application embodiment of the present invention.

FIG. 7 is a perspective view showing an application embodiment of the present invention.

This application embodiment refers to a notebook computer 50 on which the antenna device 20 is mounted.

In the notebook computer 50, a keyboard 52 and a pointing device 53 are built in a main body 51, and a display 54 is rotatably attached to the main body 51.

A bezel in the display 54 is made of a conductive material, and the antenna mounting part 12 where the antenna device 20 is mounted is formed in the bezel. Note that the antenna mounting part 12 is provided at an upper end of the display 54 so that the antenna device 20 easily receives electric waves.

The coaxial cable 40 for connecting the antenna device 20 is introduced into the main body 51 through the backside of the display 54.

Figure 8:
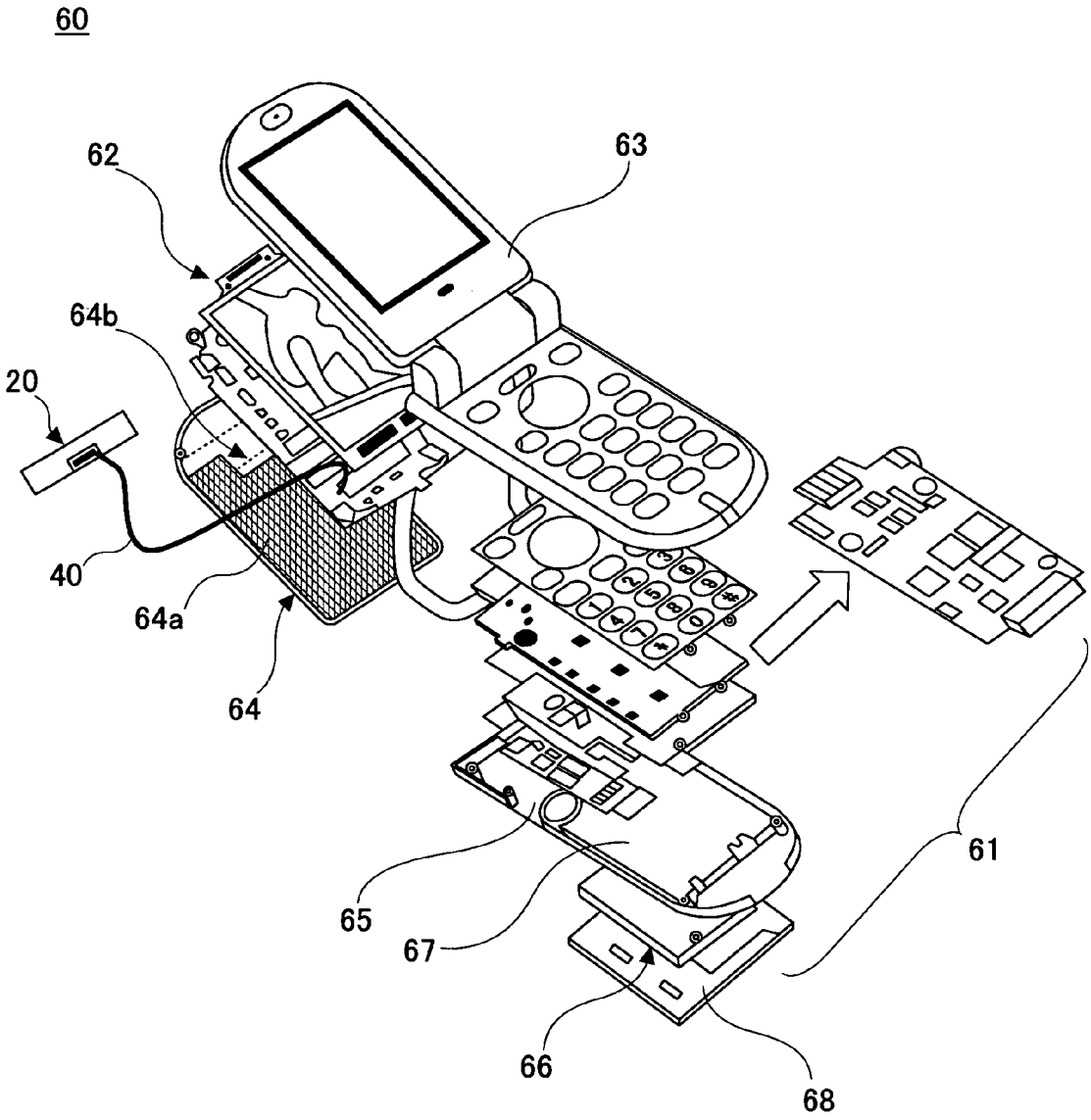
FIG. 8 is a perspective view of another application embodiment of the present invention.

FIG. 8 is a perspective view of another application embodiment of the present invention.

This application embodiment refers to a mobile terminal 60 on which the antenna device 20 is mounted.

In the mobile terminal 60, a main body 61 including a communication module, an input device, a processing unit, etc., and a display 62 are accommodated in a casing 63. The main body 61 and the display 62 are accommodated in the casing 63 such that the display 62 is rotatable relative to the main body 61.

The backside of the casing 63 is covered with covers 64 and 65. Accordingly, the main body 61 and the display 62 are accommodated inside the casing 63.

In the cover 65 is provided an accommodation part 67 that accommodates a battery 66. The battery 66 is accommodated in the accommodation unit 67 of the cover 65 and covered with a battery cover 68.

The antenna device 20 is mounted on an antenna mounting part 64*b* formed by cutting a shielding conductive film 64*a* formed on the backside of the cover 64. The antenna mounting part 64*b* is identical to the antenna mounting part 12 in shape, and the antenna device 20 is mounted on the antenna mounting part 64*b* in the same manner as the mounting structure shown in FIG. 1.

Note that it is also possible to apply the antenna device 20 to other mobile terminals such as a portable digital assistant (PDA), besides a mobile phone.

Furthermore, in the antenna device 20 according to the embodiments, the element pattern 23 is formed into a T-shape, but the element pattern 23 can provide the same antenna characteristics even if it is formed into an L-shape.

Figure 9A:
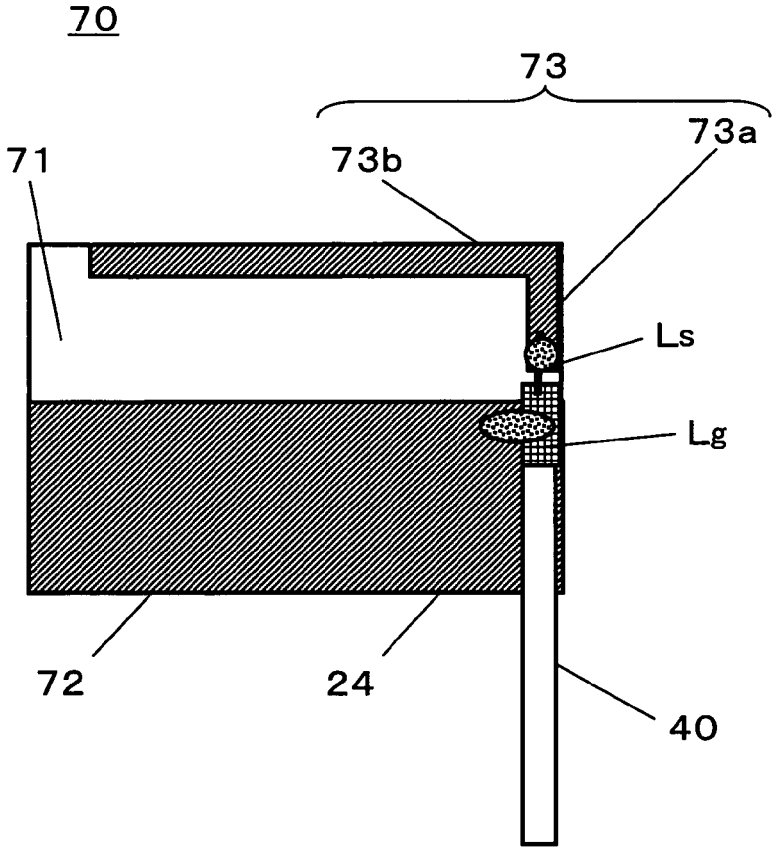
FIGS. 9A and 9B are diagrams showing a modified embodiment of the antenna device.
Figure 9B:
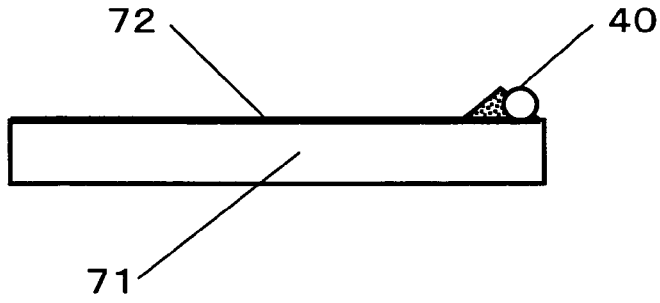

FIGS. 9A and 9B are diagrams showing a modified embodiment of the antenna device 20.

The antenna device 70 according to this modified embodiment is configured such that a ground pattern 72 and an element pattern 73 made of a conductive material are formed on a substrate 71 and the ground line and the signal line of the coaxial cable 40 are soldered to the ground pattern 72 and the element pattern 73, respectively.

The substrate 71 is made, for example, of a resinous plate material such as polyimide having a width of approximately 15 mm, a depth of approximately 10 mm, and a thickness of approximately 0.1 mm. Note that the substrate 71 may be made of a resin (dielectric) film material such as PET having flexibility.

The ground pattern 72 is a ground part of the antenna device 70 and made of a conductive material film. The ground pattern 72 is formed over approximately the entire width in the longitudinal direction and approximately half the width in the depth direction of the substrate 71.

The element pattern 73 is an element part of the antenna device 70 and made of a conductive material film having a width of approximately 1 mm or smaller. The element pattern 73 has a first element forming part 73*a* that projects substantially orthogonal to a side of the ground pattern 72; a second element forming part 73*b* is connected to a tip end of the first element forming part 73*a* and arranged substantially parallel to the side of the ground pattern 72. Note that the conductive material forming the ground pattern 72 and the element pattern 73 is, for example, a metal material such as copper or aluminum.

One end of the second element forming part 73*b* is connected to the tip end of the first element forming part 73 and the other end thereof is open, and the first and second element forming parts 73*a* and 73*b* are combined to form an L-shaped element. The L-shaped element pattern 73 electromagnetically acts on the ground pattern 72 to allow the transmission and reception of electric waves.

Note that the second element forming part 73*b* has a length of approximately 12 mm so as to be substantially parallel to the side of the ground pattern 72 at a position spaced apart by approximately 4 through 5 mm from the side of the ground pattern 72.

The ground line Lg of the coaxial cable 40 is directly soldered to the ground pattern 72 and the signal line Ls is directly soldered to the element pattern 73. Note that they may be connected to the ground pattern 72 and the element pattern 73, respectively, through coaxial connectors as shown in FIG. 1.

The antenna device 70 is mounted on the electronic apparatus 10 by a double-faced tape 80 such that the ground pattern 72 is overlapped with the conductive part 11 of the electronic apparatus 10.

Note that, in the embodiments and the modified embodiment described above, the element pattern is formed into either a T-shape or an L-shape, but the shape of the element pattern is not limited to them. Because the present invention has only to have a configuration in which the ground pattern is overlapped with the conductive part 11 of the electronic apparatus 10, the shape of the element pattern may take any form.

The present invention is not limited to the specifically disclosed embodiment, and variations and modifications may be made without departing from the scope of the present invention.

The present application is based on Japanese Priority Application No. 2007-286944 filed on Nov. 5, 2007, with the Japan Patent Office, the entire contents of which are hereby incorporated by reference.

What is claimed is:

1. An antenna device including a mounting structure for mounting the antenna device on an electronic apparatus, the antenna device comprising:

a substrate;

a conductive pattern that is formed on the substrate;

an element part that is formed from the conductive pattern; and a ground part that is formed from the conductive pattern, wherein the element part includes a first element forming part that that projects substantially orthogonal to a side of the ground pattern along the substrate and a second element forming part that is connected to a tip end of the first element forming part and arranged substantially parallel to the side of the ground pattern, the ground part is mounted on the electronic apparatus so as to be substantially overlapped with and electromagnetically coupled to a conductive part of the electronic apparatus, and a side of the conductive part of the electronic apparatus includes a concave portion formed in a plane shape and the substrate is mounted only on the conductive part in which the concave portion is formed so that the second element forming part outwardly projects from the conductive part.

2. The mounting structure of an antenna device according to claim 1, wherein the substrate has flexibility.

3. The mounting structure of an antenna device according to claim 1, wherein the antenna device is covered with an insulation material.

4. The mounting structure of an antenna device according to claim 1, wherein the element part is formed into either a T-shape or an L-shape.

5. The mounting structure of an antenna device according to claim 1, wherein the antenna device constitutes an ultra-wideband antenna.

6. The mounting structure of an antenna device according to claim 1, wherein the conductive part of the electronic apparatus is a bezel of a display unit.

* * * * *